US008091610B2

(12) United States Patent
Graham et al.

(10) Patent No.: US 8,091,610 B2
(45) Date of Patent: Jan. 10, 2012

(54) METHOD AND APPARATUS FOR REMOVING CORE MATERIAL

(75) Inventors: Lawrence D. Graham, Chagrin Falls, OH (US); Michael Capek, Richmond Heights, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 714 days.

(21) Appl. No.: 12/166,468

(22) Filed: Jul. 2, 2008

(65) Prior Publication Data

US 2010/0000700 A1 Jan. 7, 2010

(51) Int. Cl.
*B22D 29/00* (2006.01)

(52) U.S. Cl. ..... 164/132

(58) Field of Classification Search ..... 164/131, 164/132, 344–346; 134/2, 3, 22.1, 11, 22.17, 134/166 R, 105, 113, 57 R, 44
See application file for complete search history.

(56) References Cited

U.S. PATENT DOCUMENTS

| | | | |
|---|---|---|---|
| 3,563,711 | A | 2/1971 | Hammond et al. |
| 4,073,662 | A | 2/1978 | Borom |
| 4,134,777 | A | 1/1979 | Borom |
| 5,332,023 | A | 7/1994 | Mills |
| 5,779,809 | A | 7/1998 | Sangeeta |
| 5,814,161 | A | 9/1998 | Sachs et al. |
| 5,915,452 | A | 6/1999 | Conroy et al. |
| 6,739,380 | B2 | 5/2004 | Schlienger et al. |

*Primary Examiner* — Jessica L Ward
*Assistant Examiner* — Steven Ha
(74) *Attorney, Agent, or Firm* — Tarolli, Sundheim, Covell & Tummino LLP

(57) ABSTRACT

Core material is removed from a passage in a casting by exposing at least a portion of the core material in the passage to a leaching liquid. At least a portion of the core material in the passage is exposed to a gas. An opening to passage is exposed to a gas. At least a portion of the leaching liquid in the passage is boiled while the opening to the passage is exposed to a gas. At least a portion of the leaching liquid is expelled from the passage in the casting by the boiling action. To expose at least a portion of the core material in a passage to a leaching liquid, a flow of leaching liquid is conducted from a reservoir container to an operating container in which the casting is disposed. To expose at least a portion of the core material in the passage to a gas, a flow of leaching liquid is conducted from the operating container to the reservoir container.

12 Claims, 2 Drawing Sheets

METHOD AND APPARATUS FOR REMOVING CORE MATERIAL

BACKGROUND OF THE INVENTION

The present invention relates to a new and improved method and apparatus for removing core material from a casting.

The rate at which cores can be removed from a casting is controlled, in part at least, by the time required to get reacted solvent (leaching liquid) out of a passage in the core and replacing it with fresh solvent (leaching liquid). Various known methods of removing cores from passages in castings are disposed in U.S. Pat. Nos. 3,563,711; 5,332,023; 5,814,161; and 6,739,380.

SUMMARY OF THE INVENTION

The present invention relates to a new and improved method and apparatus for removing core material from a passage formed in a casting. In removing the core material from the passage, at least a portion of the core material is exposed to a leaching liquid. An opening to the passage is exposed to a gas. At least a portion of the leaching liquid in the passage is boiled while the opening to the passage is exposed to the gas. At least a portion of the leaching liquid is removed from the passage in the casting.

If desired, the casting may be put into an operating container. The operating container is then at least partially filled with the leaching liquid. The leaching liquid may be conducted from the operating container to a reservoir container under the influence of fluid pressure.

Various features of the present invention may be utilized together as disclosed herein or may be utilized separately or in combination with features from the prior art.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

Apparatus

Figure 1:
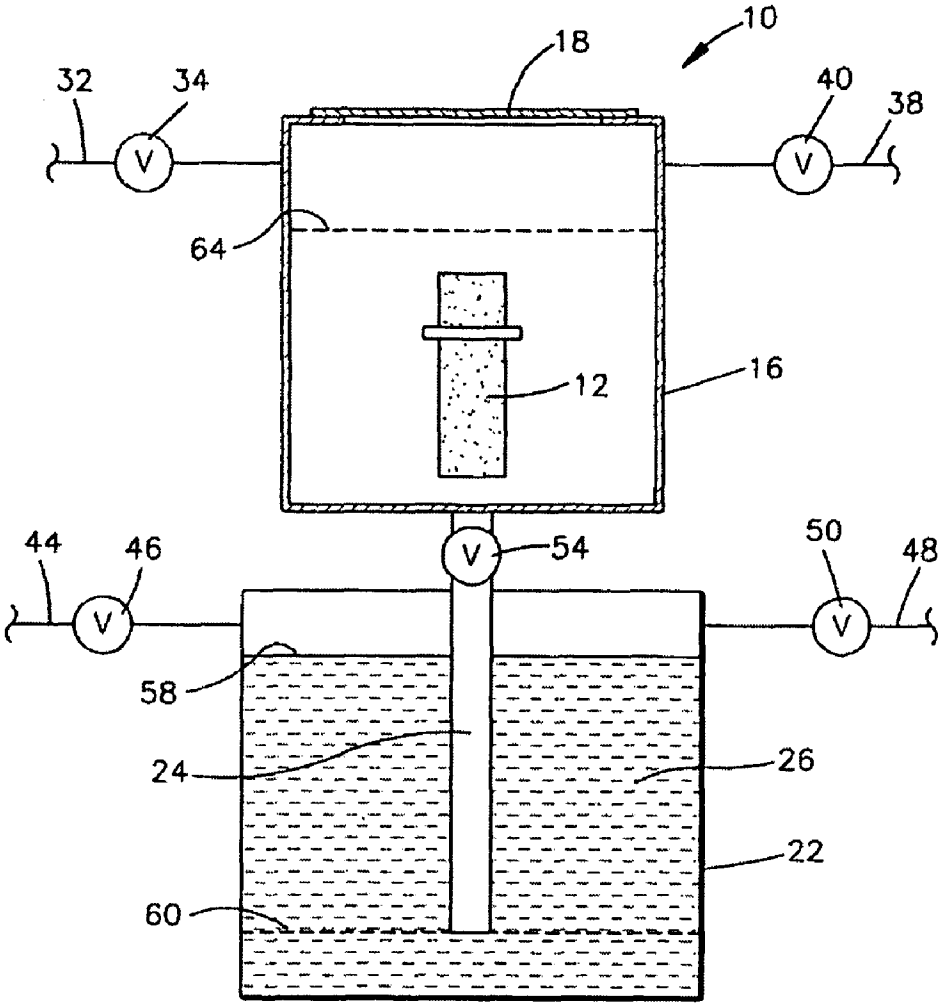
FIG. 1 is a schematic illustration of an apparatus which is utilized to remove core material from a passage formed in a casting.

An improved apparatus 10 for use in removing core material from one or more passages formed in a casting 12 is illustrated schematically in FIG. 1. The apparatus 10 includes an operating container 16 in which the casting 12 is disposed. The operating container 16 has a cover 18 which is movable from the close sealed position illustrated in FIG. 1 to an open position to provide access to the interior of the operating container 16.

A reservoir container 22 is connected with the operating container 16 by a conduit 24. The reservoir container 22 holds a supply of leaching liquid 26 (solvent). Although the reservoir container 22 is illustrated as being directly beneath the operating container 16, the reservoir container may be offset to one side of and/or located above the operating container 16.

The operating container 16 is connected with a source of gas at high pressure through a conduit 32 and a valve 34. The operating container 16 is connected with a source of low pressure fluid (vacuum) through a conduit 38 and a valve 40. Similarly, the reservoir container 22 is connected with a source of fluid (gas) under pressure through a conduit 44 and a valve 46. The reservoir container 22 is connected to a source of low pressure fluid (vacuum) through a conduit 48 and a valve 50. The valves 34, 40, 46 and 50 may be three way valves which are effective to vent the operating container 16 and reservoir container 22 to atmospheric pressure.

When a valve 54 is in an open condition, fluid can flow between the containers 16 and 22 through the conduit 24. When the valve 24 is in a closed condition, fluid flow between the container 16 and 22 through the conduit 24 is blocked. The valves 34, 40, 46, 50 and/or 54 may be three-way valves which are operable to vent the operating container 16 and/or reservoir container 22 to atmospheric pressure.

When the operating container 16 is empty and at atmospheric pressure, the cover 18 may be opened and a casting 12 put into the operating container 16. A suitable rack may be provided in the operating container to hold the casting 12. The rack may hold the casting 12 in any desired orientation in the operating container 16. Once the casting 12 has been positioned in the operating container 16, the cover 18 is closed and sealed.

The valve 40 is then operated to connect the operating container 16 with the source of gas at a relatively low pressure (vacuum). This reduces the fluid pressure in the operating container 16 and in the passages formed in the casting 12. Shortly thereafter, the valve 54 is operated to an open condition to connect the reservoir container 22 in fluid communication with the operating container 16 through the conduit 24. At this time, the valve 46 may be operated to an open condition to increase the fluid gas pressure in the reservoir container 22. This results in the solvent or leaching liquid 26 being forced, under the influence of fluid pressure in the reservoir container 22, to flow from the reservoir container through the conduit 24 and open valve 54 into the operating container 26. As this occurs, the level of the leaching liquid 26 in the reservoir container 22 drops from the relatively high level indicated at 58 in FIG. 1 to the relatively low level indicated in dashed lines at 60 in FIG. 1. At the same time, the operating container 16, in which the casting 12 is disposed, is filled with leaching liquid 26 to the level indicated schematically by the dashed line 64 in FIG. 1.

Once this has occurred, the valves 40, 46 and 54 are closed and the leaching liquid (solvent) 26 in the operating container 16 is conducted into the passages in the casting 12 to permeate the core material in the passages. Permeation of the leaching liquid 26 into the core material in the passages in the casting 12 is promoted by increasing the fluid pressure in the operating container 16. This is accomplished by opening the valve 34 while the valve 54 is closed. The resulting increase in fluid pressure in the operating container 16 is applied against the leaching liquid 26 for a period of time sufficient to force the leaching liquid into the core material in the passages in the casting 12.

After the leaching liquid 26 has permeated the core material in the passages in the casting 12, the valve 54 is opened to enable the leaching liquid to flow from the operating container 16 back to the reservoir container 22 through the conduit 24. The valve 34 may be opened to increase the fluid pressure in the operating container 16. Contemporaneously therewith, the valve 50 may be opened to decrease the fluid pressure in the reservoir container 22. This results in a flow of the leaching liquid 26 from the operating container 16 back to the reservoir container 22 through the conduit 24.

Once the leaching liquid 26 has been returned to the reservoir container 22, the valves 34 and 50 are closed. In addition, the valve 54 is closed to interrupt fluid communication between the operating container 16 and the reservoir container 22 through the conduit 24. The valve 40 is then opened to reduce the fluid pressure in the operating container 16. This reduction in the fluid pressure is more than sufficient to initiate boiling of the leaching liquid 26 in the passages in the casting 12.

This boiling of the leaching liquid is undertaken while open ends of the passages in the casting 12 are exposed to the interior of the operating container 16 and are not covered by leaching liquid. During boiling of the leaching liquid 26 in the passages in the casting 12, vapor bubbles are generated in the leaching liquid in the passages. The generation of the vapor bubbles applies force against the core material and reacted leaching liquid 26 in the passages in the casting 12. This force is effective to expel the reacted leaching liquid from the passages in the casting 12 through one or more open ends of the passages. In addition, the boiling action tends to loosen the core material in the passages in the casting 12.

Once the amount of reacted leaching liquid in the passages in the casting 12 has been reduced by boiling of the leaching liquid in the passages, the casting 12 is removed from the operating container 16 and manipulated to dump additional leaching liquid and/or particles of the core material from the passages under the influence of gravity. In addition, a stream of fluid pressure may be applied against open ends of the passages to blow the leaching liquid and/or core particles out of the passages. If desired, the steps of removing the casting 12 from the container 16 and manipulating the casting to dump leaching liquid and/or core material from the passages may be omitted.

Although the apparatus 10 may be utilized to remove cores made of many different materials from many different types of castings, it is believed that it may be particularly advantageous to utilize the apparatus 10 to remove cores containing a refractory metal, such as molybdenum, from super alloy castings using an acid as the leaching liquid 26. However, it should be understood that the apparatus 10 may be utilized to remove alumina, yittria and/or silica containing core materials from castings 12. A caustic liquid, such as, sodium or potassium hydroxide, may be used as a leaching liquid.

Of course, the apparatus 10 may be utilized to remove cores formed of other materials from the casting 12. It is contemplated that the apparatus 10 may be utilized to remove cores of many different types of materials from many different types of castings utilizing many different types of leaching liquids. The method of using the apparatus 10 may be different than the method described herein.

Method

It is contemplated that the apparatus 10 or a different apparatus may be utilized to remove core material from passages formed in the casting 12. For example, rather than exposing the casting 12 to the leaching liquid 26 (solvent) in the operating container 16 and then removing the leaching liquid from the operating container 16 and then effecting a boiling of the leaching liquid in the passages in the casting 12, two separate operating containers may be utilized. In the first operating container, the casting 12 would be exposed to the leaching liquid 26 and pressure applied against the leaching liquid to cause the leaching liquid to permeate the passages in the casting. Thereafter, the casting would be removed from this operating container and moved into a second operating container in which the pressure would be reduced to effect a boiling of the leaching liquid 26 (solvent) in the passages in the casting. This would enable the supply of leaching liquid to be maintained in one container and the second container to be substantially free of the leaching liquid.

Rather than obtaining boiling of the leaching liquid by reducing the pressure in a container, the casting 12 may be heated to effect a boiling of the leaching liquid in the passages in the casting 12. Of course, a combination of heating and pressure reduction may be utilized to effect boiling of the leaching liquid in the passages in the casting 12.

Figure 2:
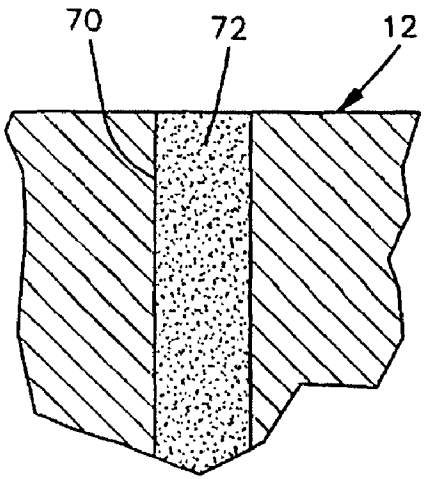
FIG. 2 is an enlarged schematic sectional view illustrating the relationship of core material to a passage in the casting.

The casting 12 has a passage 70 (FIG. 2) which is initially filled with core material 72. Although only one passage 70 has been illustrated in FIG. 2, it should be understood that there are a plurality of interconnected passages in the casting 12. These passages are all filled with the core material 72. The core material 72 may be a ceramic material containing alumina, zirconia, cilica, yittria, magnesia, and/or other materials. It is contemplated that the core material may contain a refractory metal, such as, molybdenum.

The casting 12 in which the passage 70 is disposed may be formed from a nickel chrome super alloy or other metal. Although the illustrated casting 12 is a turbine engine component, such as a blade or vane, it is contemplated that the casting 12 may have many different constructions. For example, the casting 12 may be a blade outer air seal. Of course, the casting 12 may be utilized in many different environments other than turbine engines.

To remove the core material 72 from the passage 70, the casting 12 is first exposed to a low pressure (vacuum) environment to remove as much air as possible from the passage 70. The casting 12 is then immersed in a leaching liquid 26 (solvent) in the manner illustrated schematically in FIG. 3. Fluid pressure, indicated schematically at 78 in FIG. 3 is applied against the leaching liquid 26 to force the leaching liquid to flow through an open end 80 of the passage 70 and into the core material 72 in the manner illustrated schematically in FIG. 3.

Figure 3:
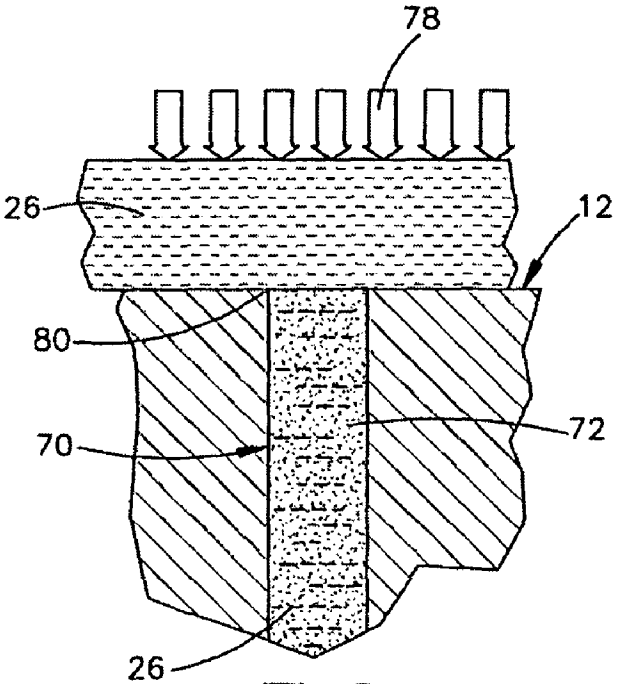
FIG. 3 is an enlarged schematic fragmentary sectional view, illustrating the manner in which leaching liquid is conducted into the core material and the passage in the casting.

The fluid pressure 78 is maintained against the leaching liquid 26 for a time sufficient to cause the leaching liquid 26 to spread or diffuse through the core material 72 in the passage 70, in the manner indicated schematically in FIG. 3. The leaching liquid 26 (solvent) will at least partially dissolve binder material in the core material 72 and will enter interstices in the core material. The leaching liquid 26 well also at least partially dissolve the core material 72. If desired, the leaching liquid 26 may be heated to further promote dissolution of the core material 72.

Once the leaching liquid 26 has thoroughly permeated the core material 72, the leaching liquid is removed from outside of the casting 12 so that the open end 80 of the passage 70 is exposed to the atmosphere surrounding the casting 12. This atmosphere may contain air and/or other gas. The pressure of the gas to which the open end of the passage 70 is exposed is then reduced.

Figure 4:
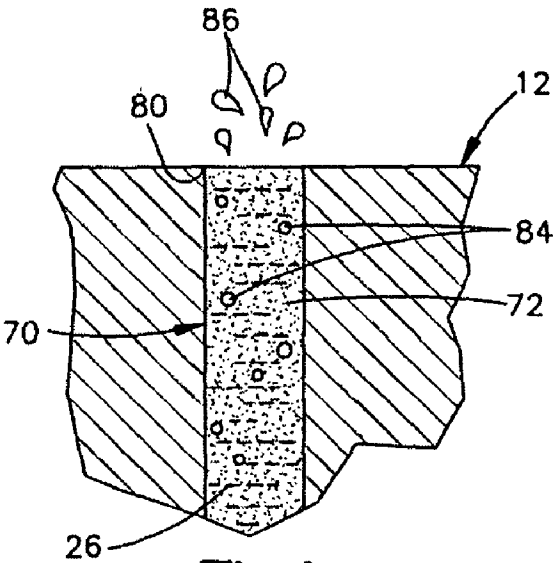
FIG. 4 is an enlarged schematic fragmentary sectional view, generally similar to FIGS. 2 and 3, illustrating the manner in which leaching liquid in the passage in the casting is boiled while an open end portion of the passage in the casting is exposed.

As the fluid pressure to which the open end 80 of the passage 70 is exposed is reduced, vapor bubbles 84 (FIG. 4)

are formed in the leaching liquid in the passage 70. The reduction in the fluid pressure to which the open end 80 of the passage 70 is exposed is sufficient so that the vapor bubbles 84 are formed with sufficient force to expel reacted leaching liquid from the passage 70, in the manner indicated schematically at 86 in FIG. 4. The boiling action with which the vapor bubbles 84 are formed may be sufficient to promote fracturing or breaking up of undissolved core material which remains in the passage 70.

Although the casting 12 has been illustrated in FIG. 4 as being in an orientation in which the open end 80 of the passage 70 faces upwardly, it is contemplated that the casting 12 may be oriented with the open end 80 of the passage 70 facing downwardly so that leaching liquid 26 and/or particles fall out of the passage 70 into the low pressure environment to which the casting 12 is exposed. If desired, the casting may be subjected to a shaking action to cause particles to fall out of the passage 70 under the influence of gravity and under the influence of the shaking action.

Figure 5:
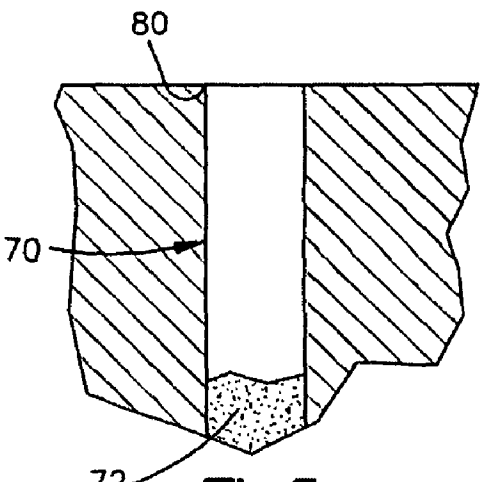
FIG. 5 is an enlarged schematic fragmentary sectional view, generally similar to FIGS. 2-4, illustrating the manner in which leaching liquid and at least a portion of the core material has been removed from the passage in the casting.

This results in at least some of the core material 72 being removed from the passage 70, in the manner illustrated schematically in FIG. 5. Although all of the core material may be removed from the passage 70 with a single boiling of the leaching liquid 26 in the passage, in the manner indicated schematically in FIG. 4, it is contemplated that only a portion of the core material 72 may be removed from the passage 70, in the manner illustrated schematically in FIG. 5. It would then be necessary to repeat the process one or more times to completely empty the passage 70 of the core material 72. In repeating the process, the casting 12 may again be exposed to the leaching liquid 26 in the manner illustrated schematically in FIG. 3. This results in the open upper (as viewed in FIG. 5) end portion of the passage 70 being filled with the leaching liquid 26. After the leaching liquid 26 has permeated the core material 72 remaining in the passage 70 under the influence of fluid pressure 78 applied against the leaching liquid, the leaching liquid is removed from around the casting 12. Fluid pressure to which the casting 12 is exposed is then reduced to effect a boiling of the leaching liquid in the remaining core material 72, in the manner illustrated schematically in FIG. 4. This results in an ejecting of reacted leaching liquid and/or core material from the passage 70. The foregoing process is repeated as many times as necessary to entirely remove the core material 72 from the passage 70.

It is contemplated that the core material 72 may contain a refractory metal. Specifically, it is contemplated that the core material 72 may contain molybdenum. When the core material 72 contains a refractory metal, such as molybdenum, the leaching liquid 26 may be an acid. Although many different acids may be utilized, it is believed that it may be preferred to use a nitric acid solution. In one specific example, the leaching liquid 26 may be a 70% (seventy percent) nitric acid solution. Of course, either a greater or lesser percentage of nitric acid may be utilized in the leaching liquid 26 if desired. It is contemplated that the leaching liquid 26 may be heated to promote dissolution of core material 72 and/or boiling of the leaching liquid.

When the core material 72 is a ceramic material, it is contemplated that the leaching liquid 26 may be a caustic material, such as an equeous alkaline hydroxide. For example, the leaching liquid 26 for a ceramic core material 72 may be sodium or potassium hydroxide.

CONCLUSION

The present invention relates to a new and improved method and apparatus for removing core material 72 from a passage 70 formed in a casting 12. In removing the core material 72 from the passage 70, at least a portion of the core material 72 is exposed to a leaching liquid 26. An opening 80 to the passage 70 is exposed to a gas. At least a portion of the leaching liquid 26 in the passage 70 is boiled while the opening 80 to the passage 70 is exposed to the gas. At least a portion of the leaching liquid 26 is removed from the passage 70 in the casting.

If desired, the casting may be put into an operating container 16. The operating container 16 is then at least partially filled with the leaching liquid 26. The leaching liquid 26 may be conducted from the operating container 16 to a reservoir container 22 under the influence of fluid pressure.

Various features of the present invention may be utilized together as disclosed herein or may be utilized separately or in combination with features from the prior art.

Having described the invention, the following is claimed:

1. A method of removing core material from a passage formed in a casting, said method comprising the steps of:

exposing at least a portion of the core material in the passage to a leaching liquid, increasing fluid pressure to permeate a portion of the leaching liquid into the core material and at least partially dissolve binder material and the core material, thereafter removing leaching liquid that did not permeate the core material thereby exposing an end of the passage to a gas, and then reducing fluid pressure to boil the permeated leaching liquid in the passage while the end of the passage is exposed to the gas.

2. A method as set forth in claim 1 further including the step of putting the casting in a container, said step of exposing at least a portion of the core material in the passage to a leaching liquid includes at least partially filling the container with the leaching liquid.

3. A method as set forth in claim 2 wherein said step of at least partially filling the container with a leaching liquid includes inducing a flow of leaching liquid into the container from a second container under the influence of fluid pressure.

4. A method as set forth in claim 1 wherein said step of reducing fluid pressure to boil the permeated leaching liquid in the passage includes generating bubbles of vapor by exposing the entrance to the passage to gas at a reduced pressure.

5. A method as set forth in claim 1 wherein said step of exposing the end of the passage to a gas includes exposing the end of the passage to a gas which is at a first pressure, said step of boiling the permeated leaching liquid in the passage includes exposing the end of the passage to a gas which is at a second pressure which is less than the first pressure.

6. A method as set forth in claim 1 further including the step of putting the casting in a first container, said step of exposing at least a portion of the core material in the passage to a leaching liquid is performed with the casting in the first container and includes conducting a flow of leaching liquid from a second container to the first container under the influence of fluid pressure, said step of exposing the end of the passage to the gas includes conducting a flow of leaching liquid from the first container to the second container under the influence of fluid pressure.

7. A method as set forth in claim 1 wherein the core material contains a refractory metal and the leaching liquid to which the core material is exposed is an acid solution.

8. A method as set forth in claim 1 wherein the core material is a ceramic material and the leaching liquid is a hydroxide solution.

9. A method as set forth in claim 1 wherein said step of reducing pressure to boil the permeated leaching liquid in the passage includes expelling leaching liquid from the passage under the influence of force transmitted from boiling leaching liquid.

10. A method of removing core material from a passage formed in a casting, said method comprising the steps of positioning the casting in a first container, exposing the casting and core material disposed in the passage in the casting to a body of leaching liquid which is held in the first container and extends around the casting and across an entrance to the passage, increasing fluid pressure in the first container to force leaching liquid into core material disposed in the passage, removing leaching liquid from the first container by conducting a flow of leaching liquid from the first container to a second container after having forced leaching liquid into core material disposed in the passage, exposing the casting and core material disposed in the passage in the casting to a body of gas which is held in the first container and extends around the casting and across the entrance to the passage, boiling leaching liquid disposed in core material in the passage by reducing fluid pressure in the body of gas in the first container, thereafter, conducting a flow of leaching liquid from the second container to the first container, exposing the casting and core material disposed in the passage in the casting to a body of leaching liquid which was conducted from the second container to the first container and which extends around the casting and across the entrance to the passage, and increasing fluid pressure in the first container to force leaching liquid into core material disposed in the passage.

11. A method as set forth in claim 10 wherein said step of conducting a flow of leaching liquid from the second container to the first container includes inducing a flow of leaching liquid into the first container from the second container under the influence of fluid pressure in the second container.

12. A method as set forth in claim 10 wherein said step of boiling leaching liquid disposed in core material in the passage includes expelling leaching liquid from the passage under the influence of force transmitted from the boiling leaching liquid.

* * * * *